US008297366B2

(12) United States Patent
Olvera et al.

(10) Patent No.: US 8,297,366 B2
(45) Date of Patent: Oct. 30, 2012

(54) INSTALLABLE LOAD SHOULDER FOR A WELLHEAD

(75) Inventors: Alfred Olvera, Houston, TX (US); Heinrich Lang, The Woodlands, TX (US)

(73) Assignee: Stream-Flo Industries Ltd., Edmonton (CA)

( * ) Notice: Subject to any disclaimer, the term of this patent is extended or adjusted under 35 U.S.C. 154(b) by 301 days.

(21) Appl. No.: 12/761,634

(22) Filed: Apr. 16, 2010

(65) Prior Publication Data

US 2010/0263877 A1 Oct. 21, 2010

Related U.S. Application Data

(60) Provisional application No. 61/170,491, filed on Apr. 17, 2009.

(51) Int. Cl.
*E21B 19/00* (2006.01)
*E21B 33/04* (2006.01)

(52) U.S. Cl. ..... 166/382; 166/75.11; 166/75.14; 166/85.1

(58) Field of Classification Search ..... 166/382, 166/75.11, 85.1, 75.14, 208
See application file for complete search history.

(56) References Cited

U.S. PATENT DOCUMENTS

| | | | | |
|---|---|---|---|---|
| 3,926,457 | A * | 12/1975 | Williams et al. | 285/39 |
| 4,577,686 | A | 3/1986 | Milberger | |
| 4,807,705 | A | 2/1989 | Henderson | |
| 4,919,460 | A | 4/1990 | Milberger | |
| 5,984,008 | A | 11/1999 | Lang et al. | |
| 6,012,519 | A | 1/2000 | Allen | |
| 6,484,382 | B1 | 11/2002 | Smith et al. | |
| 7,441,594 | B2 | 10/2008 | Vanderford | |

* cited by examiner

*Primary Examiner* — Brad Harcourt
(74) *Attorney, Agent, or Firm* — Greenlee Sullivan P.C.

(57) ABSTRACT

A system for supporting tubing with an installable load shoulder. The system includes a wellhead formed with an enlarged first circumferential groove in the wall of the vertical bore of the wellhead, and a second circumferential groove extending upwardly or downwardly from the first circumferential groove. At least one opening is formed in communication with the second circumferential groove. An annular load shoulder is received within the first circumferential groove, and has an inner surface adapted to support a tubing hanger. The load shoulder is formed from at least three arc-shaped shoulder segments adapted to be received within the first circumferential groove. At least one of the shoulder segments has an engagement member configured to pass through the opening to be received within the second circumferential groove. Rotating the load shoulder such that the engagement member is out of alignment with the opening secures the load shoulder within the wellhead.

29 Claims, 4 Drawing Sheets

INSTALLABLE LOAD SHOULDER FOR A WELLHEAD

CROSS-REFERENCE TO RELATED APPLICATION

This application claims priority from U.S. Provisional Patent Application No. 61/170,491 filed Apr. 17, 2009, which is incorporated by reference in its entirety herein to the extent that there is no inconsistency with the present disclosure.

BACKGROUND OF THE INVENTION

The present invention relates to an installable load shoulder for a wellhead, a method for installing a load shoulder in a wellhead, and a system for supporting tubing in a wellhead.

Load shoulders to support tubing hangers in a wellhead system may be installed by welding the load shoulder to the wellhead, or a load shoulder may be installed in a groove in a wellhead.

In some drilling programs, wellhead, or wellhead systems, must be capable of supporting heavy, lengthy tubing. "Tubing" or "tubing string" as used herein and in the claims is meant to be inclusive of any tubular product used in drilling and completing oil or gas wells, and is particularly inclusive of casing and production tubing. When a borehole in the earth is completed, it is customary to attach to the upper end of the well structure a wellhead, comprised of one or more wellhead members, which provide the superstructure for supporting concentrically arranged smaller diameter tubular strings. As an example, a common expedient is to suspend within a casing string, a tubing string and testing equipment that is supported by a wellhead. For this purpose it is traditional to employ a tubing hanger that is secured to a length of tubing and accordingly structure must be provided to support the tubing hanger to, or within, the wellhead. The term "tubing hanger" as used herein and in the claims is meant to be inclusive of any hanger member adapted to support a tubing, particularly including a tubing hanger, a casing hanger, a slip hanger and a mandrel.

U.S. Pat. No. 5,984,008 issued Nov. 16, 1999 to Lang et al., describes an installable load shoulder formed as a toroidal member having a split therein and a plurality of vertical openings and slots formed in the member to impart flexibility for installation. The installable load shoulder is received in a circumferential groove formed in the bore of a wellhead and functions to support a tubing hanger which in turn supports a length of tubing. This type of installable load shoulder acts somewhat like a spring to allow it to flex as it is installed through a smaller diameter vertical bore of the wellhead, but then spring outwardly into the larger diameter circumferential groove. This type of installable load shoulder is well suited for relatively low loads, limiting its applicability for higher load applications involving longer tubing strings.

U.S. Pat. No. 6,484,382 issued Nov. 26, 2002 to Smith describes the manufacture of an installable segmented load shoulder and a wellhead for same. The assembled load shoulder segments are supported in a circumferential groove formed in the bore of a wellhead. Set screws or a pin are used to secure the load shoulder to the wellhead. The segments allow the load shoulder to be stepwise installed through the smaller diameter vertical bore of the wellhead. As well, the segments allow the load shoulder to be formed from higher strength steel to support higher loads.

SUMMARY OF THE INVENTION

In accordance with the embodiments hereinafter described, the present system for supporting tubing in a wellhead may include a wellhead having a cylindrical vertical bore extending therethrough defined by a wall having a wall surface. A first circumferential groove may be formed or disposed in the wall. A second circumferential groove may be formed or disposed in the wall, extending generally upwardly or downwardly from the first circumferential groove. A portion of the wall is disposed in a spaced relationship with respect to the second circumferential groove. At least one opening is provided in the portion of the wall surface and is in communication with the second circumferential groove in the wall. A tubing hanger is disposed in the vertical bore of the wellhead and is adapted to support a length of tubing. An annular load shoulder is received within the first circumferential groove and is adapted to support the tubing hanger within the vertical bore of the wellhead. The annular load shoulder is formed from at least three arc-shaped shoulder segments adapted to be received within the first circumferential groove. At least one of the arc-shaped shoulder segments has an engagement member configured to pass through the at least one opening in the portion of the wall surface of the wellhead to be received within the second circumferential groove. In this manner, by rotating the annular load shoulder such that the engagement member is out of alignment with the at least one opening the annular load shoulder may be installed and secured within the wellhead.

Also provided is an installable annular load shoulder to be installed in a wellhead, and being configured as described above.

Also provided is a method for installing into a wellhead, an annular load shoulder as described above.

DETAILED DESCRIPTION OF THE INVENTION

The present installable load shoulder, method for installing a load shoulder in a wellhead, and a system for supporting tubing in a wellhead may be understood by reference to the following description taken in conjunction with the accompanying drawings.

Figure 1:
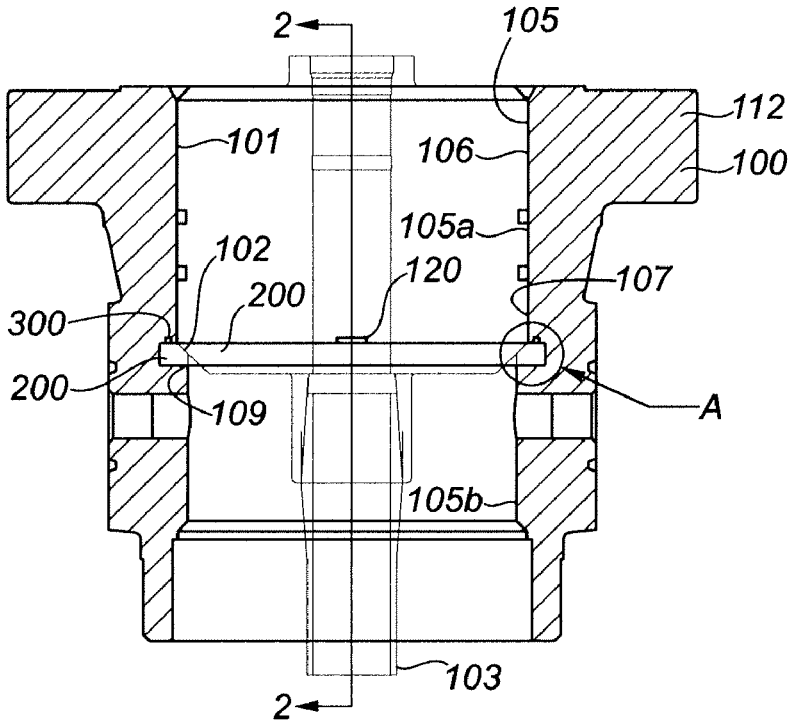
FIG. 1 is a cross-sectional view of a wellhead for use with the present installable load shoulder, with a tubing hanger and tubing being shown in phantom lines in the vertical wellbore.
Figure 2:
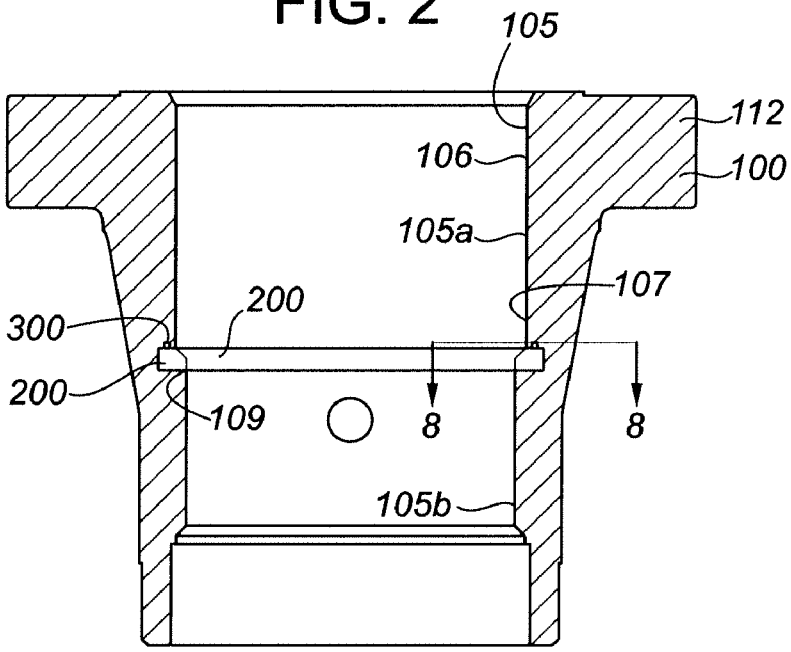
FIG. 2 is a partial cross-sectional view of the wellhead of FIG. 1, taken along line 2-2 of FIG. 1, with the tubing hanger removed.
Figure 10:
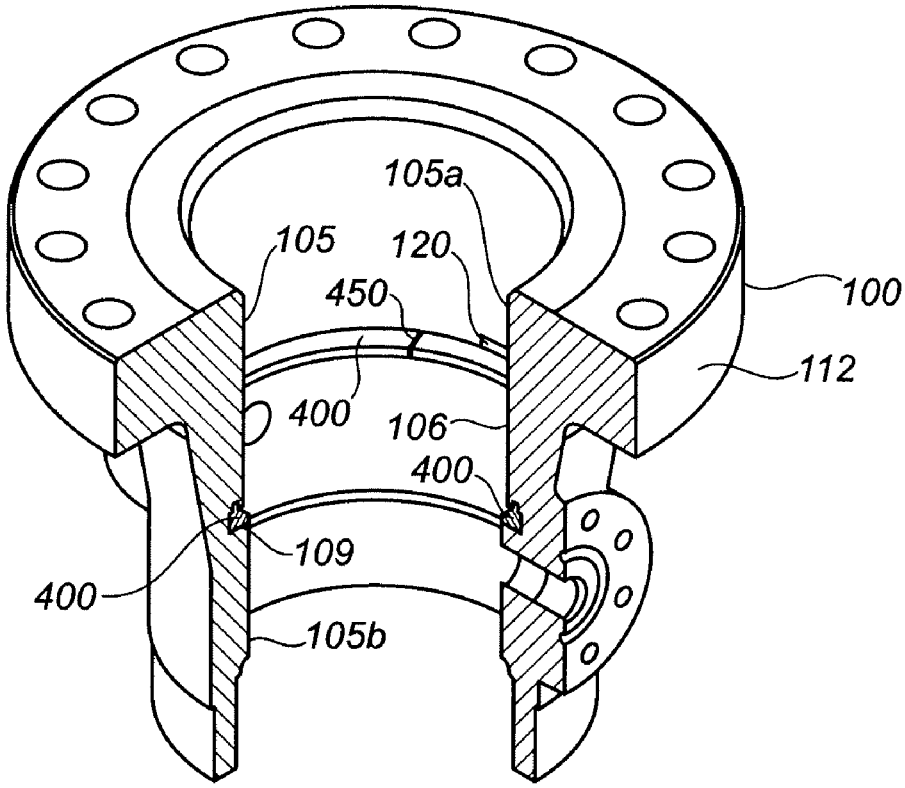
FIG. 10 is a perspective view of the wellhead of FIG. 2 with a cut-away to show the present installable load shoulder seated above the inwardly extending landing shoulder formed in the vertical bore.

With reference to FIGS. 1, 2 and 10, a pressure-containing wellhead 100 is shown, although only a portion of a complete wellhead is shown for drawing clarity. The wellhead 100 typically includes conventional top and bottom connectors to connect to wellhead equipment located above and below, such as flanged, threaded, welded or hub connections. In the Figures, a typical top flanged connector 112 is shown. In the present embodiments, the wellhead 100 functions as a tubing head to suspend tubing such as production tubing, shown schematically in phantom lines 103 in FIG. 1. However, the wellhead 100 might alternatively be a casing head or any other wellhead member which functions to suspend a casing or any other type of tubing. A conventional tubing hanger 101 is shown schematically in phantom lines in FIG. 1. Tubing hanger 101 is to be supported within wellhead 100 by the present installable load shoulder 400. Wellhead 100 includes a cylindrical vertical opening or bore 105 which extends vertically therethrough, and which is defined by a wall 106. The wall 106 has a wall surface 107 which defines the vertical opening or bore 105. It should be understood that "tubing" and "tubing hanger" should be given the broader definitions as set forth above when used herein and in the claims, with the representations shown in the Figures being only one exemplary embodiment.

With reference to FIGS. 1, 2, 8, 9 and 10, a first annular or circumferential groove 200 is formed in the wall 106 of wellhead 100. Preferably, first circumferential groove 200 is a continuous circular groove having a general rectangular cross-sectional configuration as shown by the phantom lines in FIG. 9; however, the cross-sectional configuration of groove 200 could have other shapes, such as square, trapezoidal, or frusto-conical. The first circumferential groove 200 is radially enlarged such that it has an enlarged diameter relative to that of the vertical bore 105, and the present installable load shoulder 400 is similarly radially enlarged so as to be generally received in a conforming fit within the first circumferential groove 200. As shown in FIGS. 1, 2 and 10, wall 106 of wellhead 100 may include an inwardly extending landing shoulder 109 disposed beneath first circumferential groove 200, to assist in the support of the installable load shoulder 400 within first circumferential groove 200. While landing shoulder 109 may be preferred in some situations, it is not necessary for the installation and operation of the present installable load shoulder 400. When the landing shoulder 109 is present, the installable load shoulder 400 is configured to be seated on the landing shoulder 109, within the first circumferential groove 200. As can be seen in the Figures, the landing shoulder 109 divides the wellhead 100 into a upper and lower sections, such that the diameter of the lower vertical bore section 105*b*, is reduced relative to the diameter of the upper vertical bore section 105*a*. The diameter of the first circumferential groove 200 is radially enlarged relative to the diameter of the upper vertical bore section 105*a*, such that the annular load shoulder 400 may be seated on the landing shoulder 109, and with a portion of the load shoulder 400 being held within the first circumferential groove 200.

Figure 8:
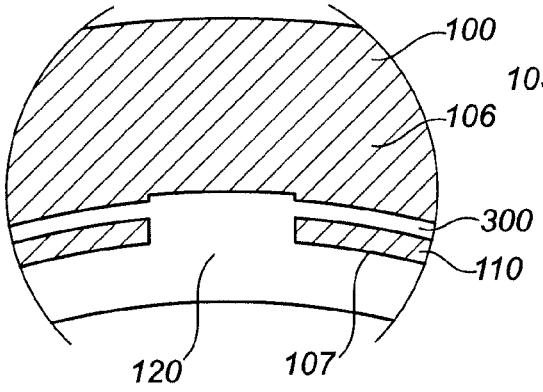
FIG. 8 is a partial cross-sectional view of the wellhead of FIG. 2 taken along line 8-8 of FIG. 2.
Figure 9:
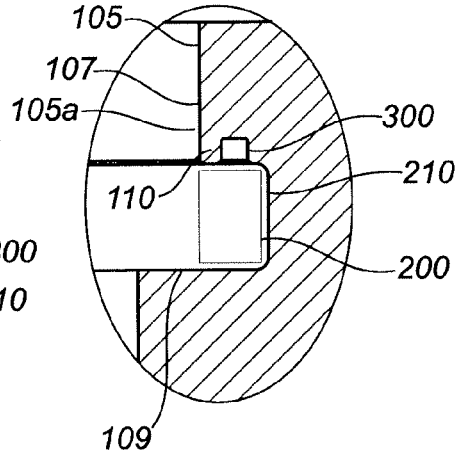
FIG. 9 is an exploded view of the portion of the wellhead circled and marked as A in FIG. 1.

Still with reference to FIGS. 1, 2, 8, 9 and 10, a second annular or circumferential groove 300 is formed in wall 106 of wellhead 100. The second circumferential groove 300 is disposed adjacent the first circumferential groove 200, and extends generally vertically upwardly as an extension of the first circumferential groove 200, as seen in FIGS. 1, 8, 9 and 10. Alternatively, although less preferably, the second circumferential groove 300 may be formed to extend generally downwardly from the first circumferential groove 200. As seen in FIGS. 8 and 9, a portion 110 of the wall 106 of the wellhead 100 remains between the second circumferential groove 300 and the wall surface 107 of the vertical bore 105. The second circumferential groove 300 thus forms an annular groove or annulus in the wall 106, in communication with the first circumferential groove 200, with the wall portion 110 serving as a lip between the groove 300 and the wall surface 107. In other words, the portion 110 of wall 106 is disposed in a spaced relationship with respect to the second circumferential groove 300. The second circumferential groove 300 may be viewed as a rabbit groove which functions to receive and retain a portion of the installable load shoulder 400 into the wall 106 of the wellhead 100. Groove 300 may be milled, or otherwise formed, in wall 106 simultaneously with the formation of the first circumferential groove 200, or in a separate groove formation step, after the first circumferential groove 200 has been formed in wall 106. The second circumferential groove 300 is preferably a continuous circular groove, although it may be discontinuous for some applications. As seen in FIG. 9, the cross-sectional configuration of the second circumferential groove 300 has a general square cross-sectional configuration; however, it could have other cross-sectional configurations such as rectangular, oval, triangular, frusto-conical, or trapezoidal. As will be hereinafter described in greater detail, a portion of the installable load shoulder 400 is received within the second circumferential groove 300 to secure the load shoulder 400 into the wellhead 100.

With reference to FIGS. 1, 2, 8, and 9, at least one opening or window 120 is formed or machined through the portion 110 of the wellhead existing between the wall surface 107 of the vertical bore 105 and the second circumferential groove 300. The at least one opening 120, as seen in FIG. 8, is in communication with the second circumferential groove 300 in the wall 106. As will be hereinafter described in greater detail, a portion of the load shoulder 400 may pass through the at least one opening 120 and may be received and locked within the second circumferential groove 300. If desired, additional openings 120 can be provided.

Figure 3:
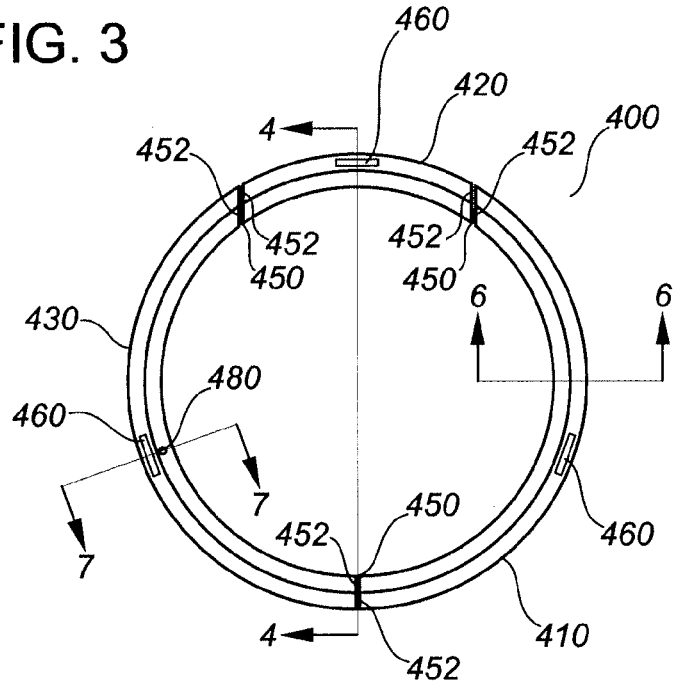
FIG. 3 is a top view of the present installable load shoulder formed from three arc-shaped shoulder segments.
Figure 4:
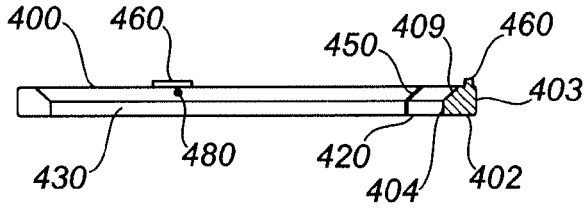
FIG. 4 is a cross-sectional view of the present installable load shoulder taken along line 4-4 of FIG. 3.
Figure 5:
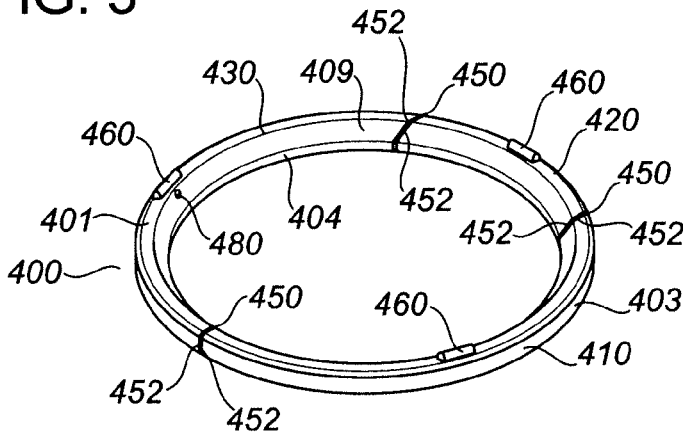
FIG. 5 is a perspective view of the present installable load shoulder of FIG. 3.
Figure 6:
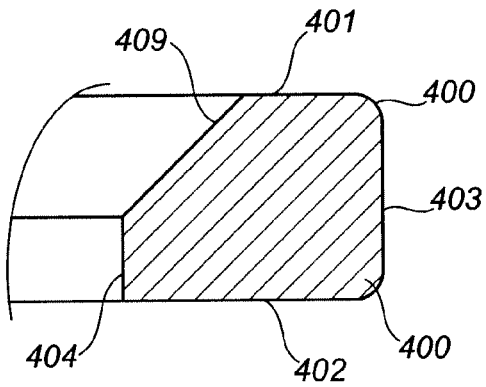
FIG. 6 is a partial cross-sectional view of the present installable load shoulder taken along line 6-6 of FIG. 3.

With reference to FIGS. 3-7, the present annular load shoulder, or installable load shoulder, 400 is illustrated. Being separate from the wellhead 100, the load shoulder 400 may be formed from high strength metal or metal alloy material (ex. high strength steel) to enable higher loads such as lengthy tubing strings to be supported in the wellhead 100. Load shoulder 400 has an upper surface 401, a lower surface 402, an outer surface 403, and an inner surface 404. Preferably, inner surface 404 includes a sloped frusto-conical surface 409 which mates with a matching frusto-conical surface (also termed landing shoulder) 102 at the bottom of tubing hanger 101 (FIG. 1). Of course inner wall surface 404 of load shoulder 400 could have other shapes, other than the configuration illustrated in FIGS. 6 and 7 in order to mate with and support an outer surface of a tubing hanger. As seen in FIGS. 3-5, installable load shoulder 400 may be formed of at least three arc-shaped shoulder members or segments, with three segments 410, 420 and 430 being shown. The three arc-shaped shoulder segments 410, 420, 430 may be formed individually, or preferably load shoulder 400 is formed as an integral annular load shoulder which is sawn at three places as indicated at parallel cut lines 450 in FIG. 3, to obtain the three arc-shaped shoulder segments 410, 420 and 430. The cut lines 450 form opposed ends 452 on each arc-shaped shoulder segment which are configured to mate with the opposed ends 452 of each adjacent arc-shaped shoulder segment 410, 420, 430. As shown in the FIG. 3 each of the arc-shaped shoulder segments 410, 420, 430 is sized such that a line drawn between its opposed ends (which might be viewed as a chord line of a circle) has a length with is less than the diameter of the upper vertical bore section 105*a*. This enables the arc-shaped segments to be fitted through the top of the wellhead and sequentially installed into the enlarged first circumferential groove 200. As seen in FIG. 3, the arc-shaped shoulder segment 420, hereinafter the last installed arc-shaped shoulder segment, is preferably sized smaller than the other two segments 410, 430, hereinafter the first and second arc-shaped shoulder segments. The opposed ends 452 of the last installed shoulder segment 420 are preferably cut, or configured, so as to lie in parallel, spaced apart planes. The opposed ends 452 of segments 410, 430 which abut with the ends 452 of the last installed arc-shaped segment 420 are similarly cut, or configured so as to lie in parallel, spaced apart planes. This ensures that the last installed arc-shaped shoulder segment 420 can be received into the first circumferential groove 200 after the larger first and second segments 410, 430 have been installed. The cut line 450 between abutting ends 452 of first and second segments 410, 430 may also be in a plane parallel to the parallel, spaced apart planes formed by the opposed ends 452 of the last installed arc-shaped shoulder segment, as shown in FIG. 3. Alternatively, the abutting ends 452 of first and second segments 410, 430 may be configured or cut with a different mating relationship, such as an angled cut.

Each of the arc-shaped shoulder segments 410, 420, 430 is shown as being provided with an engagement member or tab 460 associated therewith. At least one of the segments 410, 420, 430 is provided with the engagement member 460. Most preferably, at least the last installed arc-shaped shoulder segment 420 is formed with the engagement member 460. In the Figures, each of the arc-shaped shoulder segments 410, 420, 430 is formed with an engagement member 460. Preferably the engagement member 460 is disposed upon the upper surface 401 of load shoulder 400, and preferably it is disposed substantially intermediate the ends 452 of the individual arc-shaped shoulder segments 410, 420 430. In this manner the engagement members 460 are generally upwardly extending relative to the upper surface 401 of the load shoulder 400. The engagement members 460 have a cross-sectional shape to be received through the opening 120 in the wall 106, and into the second circumferential groove 300. As seen in FIGS. 3-5 and 7, the engagement members 460 have a generally rectangular cross-sectional configuration with a rounded upper surface 461 (FIG. 7), although other shapes and configurations for engagement members 460 could be utilized, provided the engagement members 460 may pass through the opening or window 120 (FIGS. 1 and 8) disposed in the portion 110 of the wall surface 107 of wellhead 100, to permit the installation of load shoulder 400 in wellhead 100, as will be hereinafter described. The engagement members or tabs 460 are received within the second circumferential groove 300 formed in wellhead 100 to secure the load shoulder members 410, 420, 430, within the wellhead 100. In an embodiment in which the second circumferential groove 300 is downwardly extending, engagement members may be configured to be generally downwardly extending from the lower surface of the load shoulder.

Figure 7:
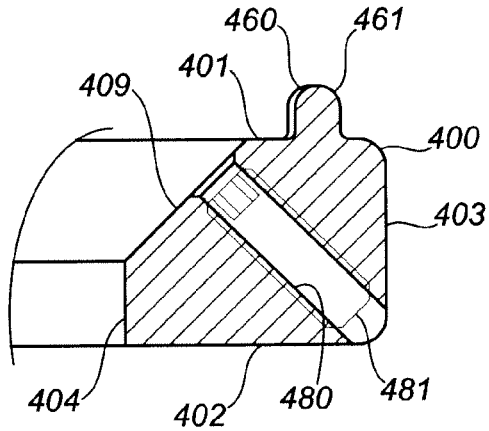
FIG. 7 is a partial cross-sectional view of the present installable load shoulder of FIG. 3, taken along line 7-7 of FIG. 3.

With reference to FIGS. 3, 4, and 7, at least one of the arc-shaped shoulder segments 410, 420, 430, may be provided with a passageway or through hole 480 extending therethrough to accommodate a set screw or pin 481 as schematically shown in phantom lines in FIG. 7. The passageway 480 may be used to fasten the load shoulder 400 into the wellhead to prevent rotation in the first circumferential groove 200, as will be hereinafter described. One or more holes (ex. drilled and tapped) may be formed in the wellhead 100 at a location to align with passageway 480 in order accept the set screw or pin 481. In FIG. 3, the passageway is shown to be formed in second arc-shaped shoulder segment 430, although it may be formed in one or both of the other segments 410, 420 if desired.

To install load shoulder 400 in wellhead 100, so as to provide a system for supporting tubing (shown in phantom lines 103 in FIG. 1) in a wellhead 100 for use in a borehole, wellhead 100 first has load shoulder 400 installed in wall 106 of wellhead 100. The arc-shaped shoulder segments 410, 430 and 420 are each sequentially placed within vertical bore 105 of wellhead 100 with engagement member or tab 460 disposed adjacent the opening or window 120. Each arc-shaped shoulder segment is then inserted into the first and second circumferential grooves 200, 300, with the engagement member 460 passing through opening 120 until the engagement member 460 is received within the second circumferential groove 300. The remaining body portion of the load shoulder 400 defined the upper, lower, and outer surfaces 401, 402, 403 (FIGS. 6 and 7), are received and supported within the first circumferential groove 200, with the outer surface 403 of each arc-shaped shoulder segment being disposed adjacent the circumferential wall 210 (FIG. 9 of the first circumferential groove 200), and with the lower surface 402 being seated on the landing shoulder 109. As the first and second arc-shaped shoulder segments 410, 430 are sequentially inserted, each may be rotated along grooves 200, 300. After the last installed arc-shaped shoulder segment 420 is inserted, all three arc-shaped shoulder segments 410, 420, 430, may be rotated to ensure that all engagement members 460 are restrained by the second circumferential groove 300, out of alignment with the opening 120, so that they cannot be passed outwardly through opening 120. Thus, the present installable load shoulder 400 is secured in the wellhead 100 through the conforming configurations of the first and second circumferential grooves 200, 300, the load shoulder itself, and the engagement members 460.

To prevent undesired rotation of the installed load shoulder 400 within the first circumferential groove 200, the one or more set screws or pins 481 may then be threaded or tapped through passageway 480 into groove 200 and into one or more holes of wellhead 100. The load shoulder 400 is thus releasably fastened within wellhead 100. After load shoulder 400 has been installed, tubing hanger 101 and tubing 103 may be installed in the conventional manner.

In an alternative embodiment a plurality of openings 120 may be provided to communicate with the second circumferential groove 300, in which case the second circumferential groove 300 may be discontinuous for some of the circumference extending between the openings 120. In such applications the second circumferential groove 300 is configured to secure the engagement member 460 out of alignment with the openings 120.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention.

One of ordinary skill in the art will appreciate that elements and materials other than those specifically exemplified can be employed in the practice of the invention without resort to undue experimentation. All art-known functional equivalents, of any such elements and materials are intended to be included in this invention within the scope of the claims, including without limitation the options and alternatives mentioned herein. The invention illustratively described herein suitably may be practiced in the absence of any element or elements, limitation or limitations which is not specifically disclosed herein.

We claim:

1. A system for supporting tubing in a borehole, comprising:

a wellhead having a cylindrical vertical bore extending therethrough defined by a wall having a wall surface, an enlarged first circumferential groove formed in the wall, a second circumferential groove formed in the wall and extending generally upwardly or downwardly from the first circumferential groove, a portion of the wall being disposed in a spaced relationship with respect to the second circumferential groove, and at least one opening formed in the portion of the wall surface, the opening being in communication with the second circumferential groove in the wall;

a tubing hanger disposed in the vertical bore of the wellhead and adapted to support a length of tubing; and an annular load shoulder received within the first circumferential groove, the annular load shoulder having an inner surface adapted to support the tubing hanger within the vertical bore of the wellhead, the annular load shoulder being formed from at least three arc-shaped shoulder segments adapted to be received within the first circumferential groove, at least one of the arc-shaped shoulder segments having an engagement member extending generally upwardly or downwardly from the arc-shaped shoulder segment and configured to pass through the at least one opening in the portion of the wall surface of the wellhead to be received within the second circumferential groove, whereby by rotating the annular load shoulder such that the engagement member is out of alignment with the at least one opening, the annular load shoulder may be installed and secured within the wellhead.

2. The system of claim 1, wherein:

the wellhead is formed with an inwardly extending landing shoulder in the vertical bore so as to form an upper cylindrical vertical bore section having a first diameter and a lower cylindrical vertical bore section having a second diameter which is reduced relative to the first diameter; and the enlarged first circumferential groove is formed above the inwardly extending landing shoulder with a third diameter which is enlarged relative to the first diameter, and such that the annular load shoulder may be seated on the landing shoulder.

3. The system of claim 2, wherein the second circumferential groove extends generally upwardly from the first circumferential groove, and wherein the engagement member extends generally upwardly from an upper surface of the arc-shaped shoulder segment so as to be received in the second circumferential groove.

4. The system of claim 3, wherein an inner surface of the at least three arc-shaped shoulder segments forms a frusto-conical surface to mate with a matching frusto-conical surface formed on the tubing hanger.

5. The system of claim 3, wherein the wellhead is a casing head, the tubing hanger is a casing hanger, and the tubing is a casing.

6. The system of claim 3, wherein the wellhead is a tubing head, the tubing hanger is adapted to support production tubing.

7. The system of claim 3, wherein each arc-shaped segment has opposed ends, each arc-shaped shoulder segment is sized such that a line drawn between its opposed ends has a length less than the first diameter of the upper vertical bore section, and the opposed ends of each arc-shaped shoulder segment are configured to mate with the opposed ends of an adjacent arc-shaped shoulder segment to allow the three arc-shaped shoulder segments to be sequentially installed into the first circumferential groove to form the annular landing shoulder.

8. The system of claim 7, wherein the one of the at least three arc-shaped shoulder segments forms a last installed arc-shaped shoulder segment, and wherein the opposed ends of the last installed arc-shaped shoulder segment are configured so as to lie in parallel, spaced apart planes.

9. The system of claim 8, wherein the last installed arc-shaped shoulder segment includes the engagement member.

10. The system of claim 9, wherein the annular load shoulder is formed from three arc-shaped shoulder segments, a first arc-shaped shoulder segment, a second arc-shaped shoulder segment, and the last installed arc-shaped shoulder segment, and wherein the abutting ends of the first and second arc-shaped shoulder segments are configured to lie in a plane parallel to the parallel, spaced apart planes formed by the opposed ends of the last installed arc-shaped shoulder segment.

11. The system of claim 9, wherein at least one of the arc-shaped shoulder segments is formed with a passageway extending therethrough, the passageway being adapted to accept passage of a set screw or pin, and wherein the wellhead is adapted to accept the set screw or pin in order to prevent rotation of the annular load shoulder once installed.

12. A load shoulder adapted to be installed in a wellhead, the wellhead having a cylindrical vertical bore extending therethrough defined by a wall having a wall surface, the load shoulder comprising:

an installable, annular load shoulder adapted to be received in an enlarged first circumferential groove formed in the wall of the wellhead, the annular load shoulder forming an inner surface adapted to support a tubing hanger within the vertical bore of the wellhead, the annular load shoulder being formed from at least three arc-shaped shoulder segments adapted to be received within the first circumferential groove, at least one of the arc-shaped shoulder segments having an engagement member extending generally upwardly or downwardly from the arc-shaped shoulder segment and configured to be received in a second circumferential groove formed in the wall of the vertical bore and extending upwardly or downwardly from the first circumferential groove, the engagement member being configured to pass through an opening formed in a portion of the wall surface of the wellhead so as to communicate with the second circumferential groove, such that the engagement member is received in the second circumferential groove, whereby by rotating the annular load shoulder such that the engagement member is out of alignment with the at least one opening, the annular load shoulder may be installed and secured within the wellhead.

13. The load shoulder of claim 12, wherein the wellhead is formed with an inwardly extending landing shoulder in the vertical bore so as to form an upper cylindrical vertical bore section having a first diameter and a lower cylindrical vertical bore section having a second diameter which is reduced relative to the first diameter;

wherein the enlarged first circumferential groove is formed above the inwardly extending landing shoulder with a third diameter which is enlarged relative to the first diameter, and wherein the annular load shoulder is configured to be seated on the landing shoulder.

14. The load shoulder claim 13, wherein the second circumferential groove extends generally upwardly from the first circumferential groove, and wherein the engagement member extends generally upwardly from an upper surface of the arc-shaped shoulder segment so as to be received in the second circumferential groove.

15. The load shoulder of claim 14, wherein an inner surface of the at least three arc-shaped shoulder segments forms a frusto-conical surface to mate with a matching frusto-conical surface formed on the tubing hanger.

16. The load shoulder of claim 14, wherein each arc-shaped segment has opposed ends, each arc-shaped shoulder segment is sized such that a line drawn between its opposed ends has a length less than the first diameter of the upper vertical bore section, and the opposed ends of each arc-shaped shoulder segment are configured to mate with the opposed ends of an adjacent arc-shaped shoulder segment to allow the three arc-shaped shoulder segments to be sequentially installed into the first circumferential groove to form the annular landing shoulder.

17. The load shoulder of claim 16, wherein the one of the at least three arc-shaped shoulder segments forms a last installed arc-shaped shoulder segment, and wherein the opposed ends of the last installed arc-shaped shoulder segment are configured so as to lie in parallel, spaced apart planes.

18. The load shoulder of claim 17, wherein the last installed arc-shaped shoulder segment includes the engagement member.

19. The load shoulder of claim 18, wherein the annular load shoulder is formed from three arc-shaped shoulder segments, a first arc-shaped shoulder segment, a second arc-shaped shoulder segment, and the last installed arc-shaped shoulder segment, and wherein the abutting ends of the first and second arc-shaped shoulder segments are configured to lie in a plane parallel to the parallel, spaced apart planes formed by the opposed ends of the last installed arc-shaped shoulder segment.

20. The load shoulder of claim 18, wherein at least one of the arc-shaped shoulder segments is formed with a passageway extending therethrough, the passageway being adapted to accept passage of a set screw or pin, and wherein the wellhead is adapted to accept the set screw or pin in order to prevent rotation of the annular load shoulder once installed.

21. A method for installing a load shoulder in a wellhead, the method comprising:

providing a wellhead having a cylindrical vertical bore extending therethrough defined by a wall having a wall surface, an enlarged first circumferential groove formed in the wall, a second circumferential groove formed in the wall and extending generally upwardly or downwardly from the first circumferential groove, a portion of the wall being disposed in a spaced relationship with respect to the second circumferential groove, and at least one opening formed in the portion of the wall surface, the opening being in communication with the second circumferential groove in the wall;

providing an annular load shoulder sized to be received within the first circumferential groove, the annular load shoulder having an inner surface adapted to support a tubing hanger within the vertical bore of the wellhead, the annular load shoulder being formed from at least three arc-shaped shoulder segments adapted to be received within the first circumferential groove, at least one of the arc-shaped shoulder segments having an engagement member configured to pass through the at least one opening in the portion of the wall surface of the wellhead to be received within the second circumferential groove;

sequentially installing the at least three arc-shaped shoulder segments in the first circumferential groove, with the last installed of the arc-shaped load shoulder segments having the engagement member which passes through the at least one opening to be received in the second circumferential groove; and rotating the annular load shoulder such that the engagement member is out of alignment with the at least one opening to secure the annular load shoulder within the wellhead.

22. The method of claim 21, wherein:

the wellhead is formed with an inwardly extending landing shoulder in the vertical bore so as to form an upper cylindrical vertical bore section having a first diameter and a lower cylindrical vertical bore section having a second diameter which is reduced relative to the first diameter;

the enlarged first circumferential groove is formed above the inwardly extending landing shoulder with a third diameter which is enlarged relative to the first diameter; and the annular load shoulder is installed to be seated on the landing shoulder.

23. The method of claim 22, wherein the second circumferential groove extends generally upwardly from the first circumferential groove, and wherein the engagement member extends generally upwardly from an upper surface of the arc-shaped shoulder segment so as to be received in the second circumferential groove during installing.

24. The method of claim 23, wherein an inner surface of the at least three arc-shaped shoulder segments forms a frusto-conical surface to mate with a matching frusto-conical surface formed on the tubing hanger.

25. The method of claim 23, wherein each arc-shaped segment has opposed ends, each arc-shaped shoulder segment is sized such that a line drawn between its opposed ends has a length less than the first diameter of the upper vertical bore section, and the opposed ends of each arc-shaped shoulder segment are configured to mate with the opposed ends of an adjacent arc-shaped shoulder segment to allow the three arc-shaped shoulder segments to be sequentially installed into the first circumferential groove to form the annular landing shoulder.

26. The method of claim 25, wherein the one of the at least three arc-shaped shoulder segments forms a last installed arc-shaped shoulder segment, and wherein the opposed ends of the last installed arc-shaped shoulder segment are configured so as to lie in parallel, spaced apart planes.

27. The method of claim 26, wherein the last installed arc-shaped shoulder segment includes the engagement member.

28. The method of claim 27, wherein the annular load shoulder is formed from three arc-shaped shoulder segments, a first arc-shaped shoulder segment, a second arc-shaped shoulder segment, and the last installed arc-shaped shoulder segment, and wherein the abutting ends of the first and second arc-shaped shoulder segments are configured to lie in a plane parallel to the parallel, spaced apart planes formed by the opposed ends of the last installed arc-shaped shoulder segment.

29. The method of claim 27, wherein at least one of the arc-shaped shoulder segments is formed with a passageway extending therethrough, and wherein the method includes inserting a screw or pin through the passageway and into the wellhead to prevent rotation of the annular load shoulder once installed.

* * * * *